US008063847B2

(12) United States Patent
Du

(10) Patent No.: US 8,063,847 B2
(45) Date of Patent: Nov. 22, 2011

(54) MULTI-BAND ANTENNA

(75) Inventor: Xin Du, Schaumburg, IL (US)

(73) Assignee: PCTEL, Inc., Bloomingdale, IL (US)

( * ) Notice: Subject to any disclaimer, the term of this patent is extended or adjusted under 35 U.S.C. 154(b) by 718 days.

(21) Appl. No.: 12/187,032

(22) Filed: Aug. 6, 2008

(65) Prior Publication Data

US 2009/0256778 A1 Oct. 15, 2009

Related U.S. Application Data

(60) Provisional application No. 61/043,918, filed on Apr. 10, 2008.

(51) Int. Cl.
*H01Q 1/36* (2006.01)
*H01Q 21/20* (2006.01)

(52) U.S. Cl. ..... 343/897; 343/893; 343/834; 343/799

(58) Field of Classification Search ..... None
See application file for complete search history.

(56) References Cited

U.S. PATENT DOCUMENTS 3,560,978 A * 2/1971 Himmel et al. ..... 342/399
5,839,282 A * 11/1998 Bronicki et al. ..... 60/641.5
6,919,859 B2 * 7/2005 McCarthy et al. ..... 343/895
7,330,154 B2 * 2/2008 Kanazawa ..... 343/702
2003/0193446 A1 * 10/2003 Chen ..... 343/893
2005/0237258 A1 * 10/2005 Abramov et al. ..... 343/834
2007/0008236 A1 * 1/2007 Tillery et al. ..... 343/797

* cited by examiner

*Primary Examiner* — Trinh Dinh

(74) *Attorney, Agent, or Firm* — Husch Blackwell LLP

(57) ABSTRACT

A multi-band antenna is provided that operates in non-harmonically related frequency bands. The antenna includes a primary antenna element for a first frequency band of the non-harmonically related bands, said primary antenna element extending perpendicularly from a ground plane, the primary antenna element electrically isolated from the ground plane, a plurality of secondary elements extending from the ground plane parallel to the primary antenna element and arranged in a circle around the primary antenna element, each of said plurality of secondary elements electrically isolated from the primary antenna element and ground plane and a plurality of antenna elements for a second frequency band of a higher relative frequency than the first frequency band, the plurality of high frequency antenna elements extending parallel to the primary and secondary antenna elements and disposed in a circle around the secondary antenna elements.

20 Claims, 6 Drawing Sheets

MULTI-BAND ANTENNA

This application is a continuation-in-part of U.S. Provisional Patent Application No. 61/043,918 filed on Apr. 10, 2008 (pending).

FIELD OF THE INVENTION

The field of the invention relates to radio frequency antenna and more particularly to antenna that operate in a number of different non-harmonically related frequencies.

BACKGROUND OF THE INVENTION

Digital wireless systems, such as wireless local area networks, may exist in a number of different frequency bands and may each use a unique communication protocol. For example, cellular and GSM telephones may operate in the 700-960 MHz frequency band, PCS and UMTS may operate in the 1700-2170 MHz frequency band and WIFI may operate in the 2.4-5.8 GHz bands.

However, PCS, UMTS and WIFI are often used with different types of devices, each with a different functionality and data processing capability. Because of the different functionality, it is often necessary for service providers to provide simultaneous infrastructure access under each of the available protocols.

One complicating factor with providing simultaneous access is that access under PCS, UMTS or WIFI often occurs in an office or commercial environment. While the environment could also be out-of-doors, the environment could also involve use within a restaurant, theater or other user space. Such environments do not allow for the use of bulky antenna or antenna structure that detract from the architecture of the space.

Another complicating factor is that PCS, UMTS and WIFI use frequency bands that are not harmonically related. As such, an antenna designed for one frequency band may not work with other bands.

One prior art solution to the problem of multiple frequency bands has been to combine a sleeve and choke into a multi-band antenna. This solution involves the use of a whip antenna with a sleeve choke surrounding the base of the whip antenna. The sleeve would typically be ¼ wavelength of the target frequency while the whip would extend another ¼ wavelength above the end of the sleeve choke. Because the choke and whip are both ¼ wavelength of the target frequency, it is difficult to tune the resulting antenna to more than one frequency band where the bands are not harmonically related. Accordingly, a need exist for better antenna that operate in multiple non-harmonically related frequency bands.

SUMMARY

A multi-band antenna is provided that operates in non-harmonically related frequency bands. The antenna includes a primary antenna element for a first frequency band of the non-harmonically related bands, said primary antenna element extending perpendicularly from a ground plane, the primary antenna element electrically isolated from the ground plane, a plurality of secondary elements extending from the ground plane parallel to the primary antenna element and arranged in a circle around the primary antenna element, each of said plurality of secondary elements electrically isolated from the primary antenna element and ground plane and a plurality of antenna elements for a second frequency band of a higher relative frequency than the first frequency band, the plurality of high frequency antenna elements extending parallel to the primary and secondary antenna elements and disposed in a circle around the secondary antenna elements.

DETAILED DESCRIPTION OF AN ILLUSTRATED EMBODIMENT

Figure 1:
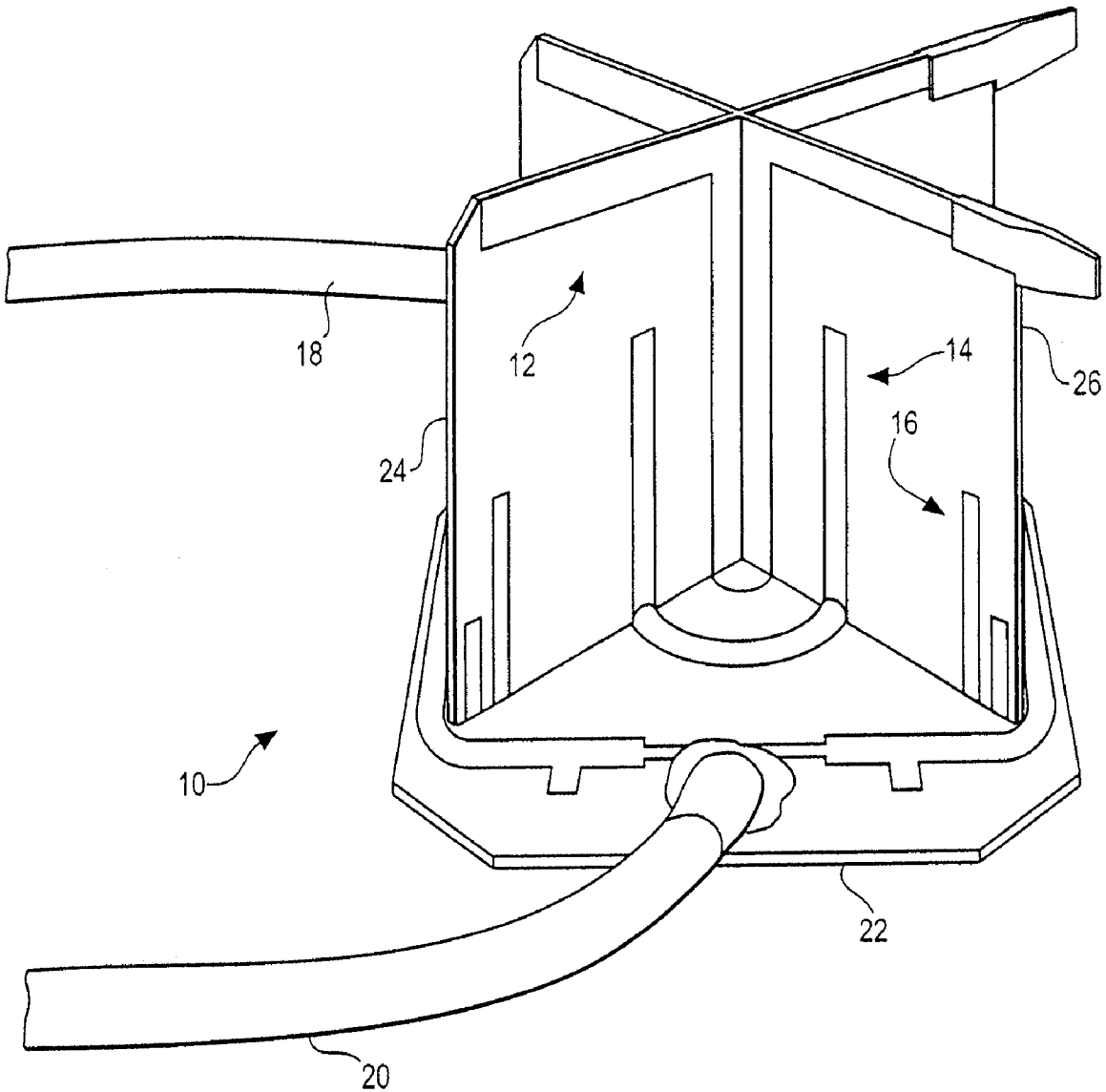
FIG. 1 is a side perspective view of a multi-band antenna in accordance with an illustrated embodiment of the invention.

FIG. 1 is a side perspective view of a multi-band antenna 10 shown generally in accordance with an illustrated embodiment of the invention. The antenna 10 may be used as a mobile or stationary antenna for a number of different frequency bands including, but not limited to, 750/800/900 MHz/PCS/UMTS/WIFI (2.4/5.8 GHz).

In general, the antenna 10 may be divided into a number of different antenna substructures. For example, an electrically conductive primary antenna element 12 may be used for radio frequency (rf) transmission in a relatively low frequency band. Another electrically conductive secondary antenna 14 may be used for rf transmission in an intermediate band and still another electrically conductive high frequency antenna 16 may be used for rf transmission in a high frequency band.

A first antenna feed (e.g., coaxial cable) 18 may be used to couple an rf signal in the relatively low frequency band to the primary antenna 12 and secondary antenna 14. A second antenna feed (e.g., coaxial cable) 20 may be used to couple an rf signal in the relatively high frequency band to the high frequency antenna 16.

As may be noted from FIG. 1, the antenna 10 may be inexpensively fabricated from three electrically non-conductive printed circuit boards (PCBs) 22, 24, 26 with an appropriate set of metallic (e.g., copper) traces that function as antenna elements and/or connection elements. The first two PCBs may be antenna element PCBs 24, 26 and may be provided with respective slots 28 near their centers, parallel to at least some the antenna radiating elements to allow the antenna PCBs 24, 26 to be interleaved so that the PCBs 24, 26 cross, orthogonally. The crossed PCBs 24, 26 may then be electrically coupled to the third PCB such as an antenna feed PCB 22 via an appropriate conductive material (e.g., solder).

Figure 2B:
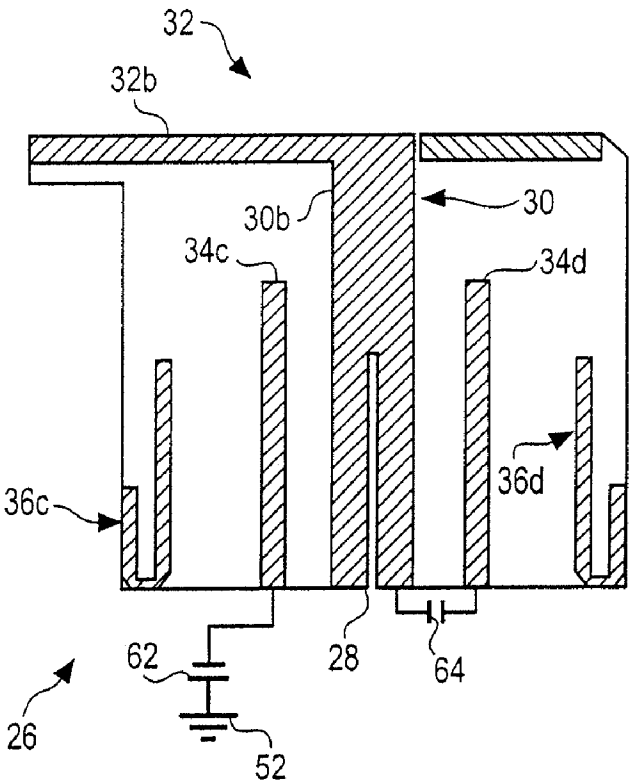
FIG. 2 depicts side views of antenna PCBs of the antenna of FIG. 1.
Figure 2A:
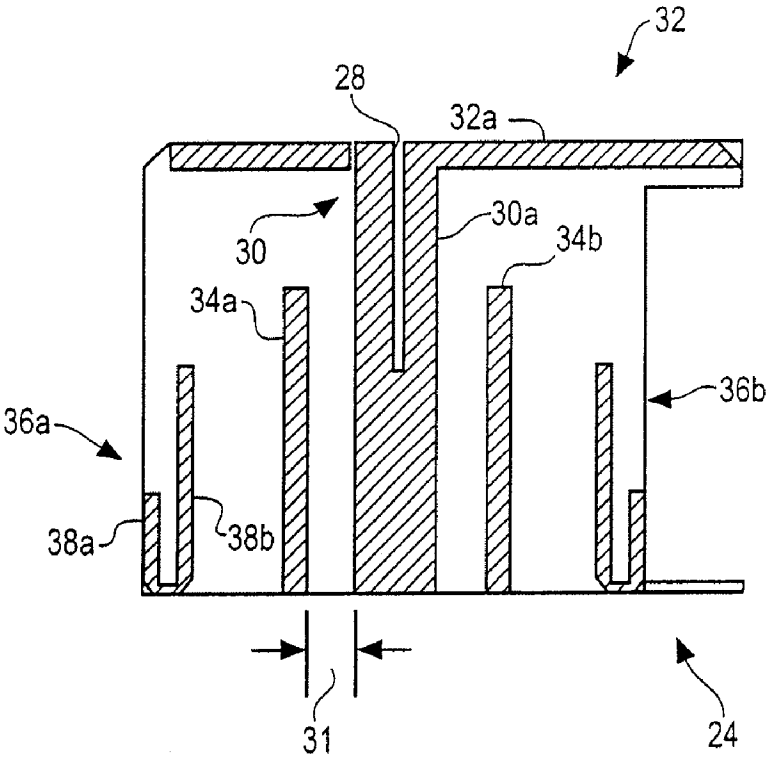
Figure 3B:
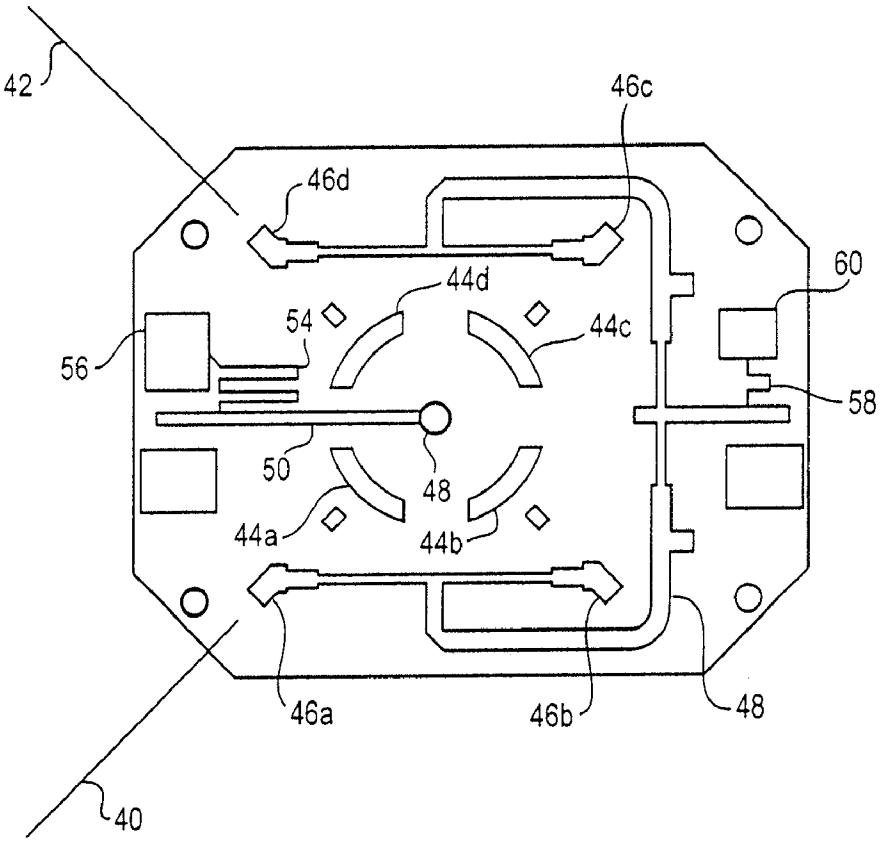
FIG. 3 depicts front and back views of an antenna feed PCB of the antenna of FIG. 1.
Figure 3A:
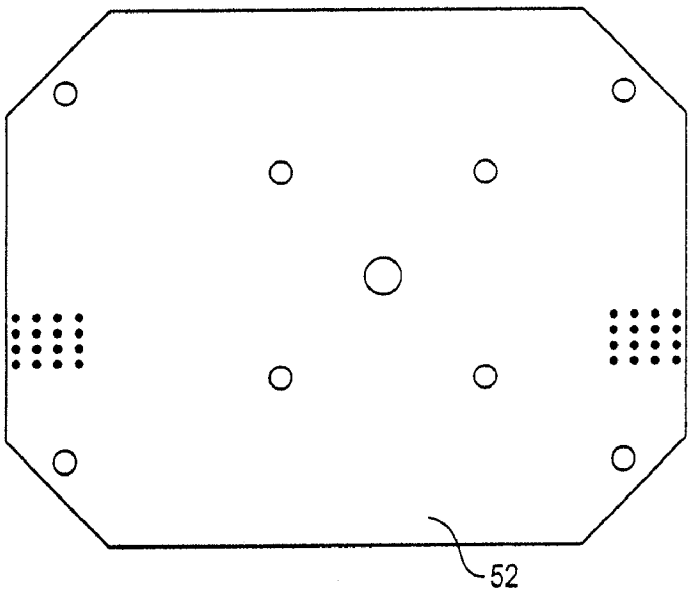

FIG. 2 depicts side views of the antenna PCBs 24, 26. FIG. 3 depicts top and bottom views of the feed PCB 22.

As may be observed from FIGS. 1-3, the primary antenna element 12 may include a vertical member 30 and a horizontal top member 32. The vertical member 30 may include a set of crossed sub-members 30*a-b*. Similarly, the top member 32 may also include a set of crossed sub-members 32*a-b*.

Also present on the antenna PCBs 24, 26 is a secondary antenna 14 including a set of secondary antenna elements 34*a-d*. As shown, the secondary elements 34*a-d* are parallel with the primary antenna element 30 and are disposed in a spaced-apart relationship with the primary element 12. The secondary antenna elements 34*a-d* are electrically isolated from the primary antenna element 12 at least by a distance 31 that separates the primary element 12 and secondary antenna elements 34*a-d*.

The high frequency antenna 16 may also be disposed on the antenna PCBs 24, 26. As shown, the high frequency antenna elements 36*a-d* of the high frequency antenna 16 are parallel with the primary antenna element 30 and secondary antenna elements 34*a-d* and are also spaced apart from the primary and secondary elements 30, 34*a-d*. As shown in FIG. 2, each of the high frequency elements 36*a-d* further include a pair of parallel antenna elements including a relatively long inner antenna element 38*b* and a relatively shorter outer member 38*a*.

When assembled to the antenna feed PCB 22, the antenna PCBs 24, 26 are each disposed parallel to a respective axis 40, 42 (FIG. 3). As shown in FIGS. 1 and 3, the primary antenna 12 is connected on a proximal end to a board pad 48. The board pad 48 may be connected through a metal trace 50 to the rf feed 18.

The secondary antenna elements 34*a-d* may each be electrical connected to a respective electrically conductive support pad 44*a-d* on the antenna feed board 22. As shown in FIG. 3, the support pads 44*a-d* and secondary antenna elements 34*a-d* are arranged in a circle around the primary antenna element 12 with the primary antenna element 12 located at a center of the circle.

The support pads 44*a-d* are electrically isolated (in a direct current sense) from the primary antenna element 12, the high frequency antenna 16 and a ground plane 52 that is disposed on a back or bottom side of the antenna feed PCB 22. However, the support pads 44*a-d* are also coupled (in an alternating current sense) capacitively to the ground plane 52 (shown figuratively by capacitor 62 in FIG. 2). The amount of capacitive coupling between the each secondary antenna element 34*a-d* and the ground plane 52 is determined by the area of the support pads 44*a-d* and/or the thickness of the dielectric material of the PCB 22.

In a similar manner, the secondary antenna elements 34*a-d* are also capacitively coupled to the primary antenna element 12 (shown figuratively by capacitor 64 in FIG. 2). The amount of capacitive coupling between the secondary antenna elements 34*a-d* and the primary antenna 12 is determined by the spacing 31 between the secondary antenna elements 34*a-d* and primary antenna 12 and/or by the dielectric disposed in the space between the secondary elements 34*a-d* and primary antenna 12. In effect, the secondary antenna elements 34*a-d* electrically float between the electrical potential of the ground plane 52 and primary antenna element 12 with the potential at any instant of time determined by the relative capacitive coupling between the secondary antenna elements 34*a-d* and each of the primary antenna 12 and ground plane 52.

Upon assembly of the antenna PCBs 24, 26 to the antenna feed PCB 22, the high frequency antenna elements 36*a-d* are each electrically coupled to a respective electrically conductive connection pad 44*a-d*.

Similarly, when the antenna PCBs 24, 26 are combined with the feed PCB, a proximal end of the high frequency elements 36*a-d* are respectively electrically connected to an electrically conductive pad 46*a-d*. The pads 46*a-d*, in turn, are connected through an electrically conductive trace 48 to the rf feed 20.

In order to reduce the incidence of unwanted parasitics, a pair of shunt connections 54, 58 are provided that shunt low frequency signals to the ground plane 52. The first shunt 54 connects the rf feed 50 to the ground plane through plated area 56. In this case, the first shunt 54 has a length defined by ¼ wavelength of a base frequency of the low frequency band.

Similarly, the second shunt 58 connects the rf feed 48 to the ground plane 52 through plated area 60. The second shunt 58 has a length defined by ¼ wavelength of a base frequency of the high frequency band.

In general, the antenna 10 can be used for any of a number of different non-harmonically related frequency bands. By varying the lengths and widths of the antenna elements 30*a-b*, 34*a-d* along with the size and area of the support pads 44*a-d*, the primary antenna 12 and secondary antenna 14 may be tuned for response to at least two target bands. Similarly, the spacing 31 between the secondary antenna elements 34*a-d* and primary antenna 12 may be filled with a desired dielectric material, allowing further manipulation of the resulting capacitive coupling.

In general, the primary antenna 12 operates in the lower end of the low frequency band as the primary radiator. At frequencies above the lower end, the capacitive coupling of the secondary antenna elements 34*a-d* allow the secondary antenna elements 34*a-d* to begin radiating in the middle frequencies of the lower band. At frequencies near the upper end of the lower band, the secondary antenna elements 34*a-d* may become the primary radiator.

The high frequency antenna elements 36*a-d* function to radiate in the high frequency band. A first element 38*a* of each of the high frequency antenna elements 36*a-d* may be the primary radiator in the upper extreme of the high frequency band. The second element 38*b* may be the primary radiator at the lower end of the high frequency band.

Figure 4:
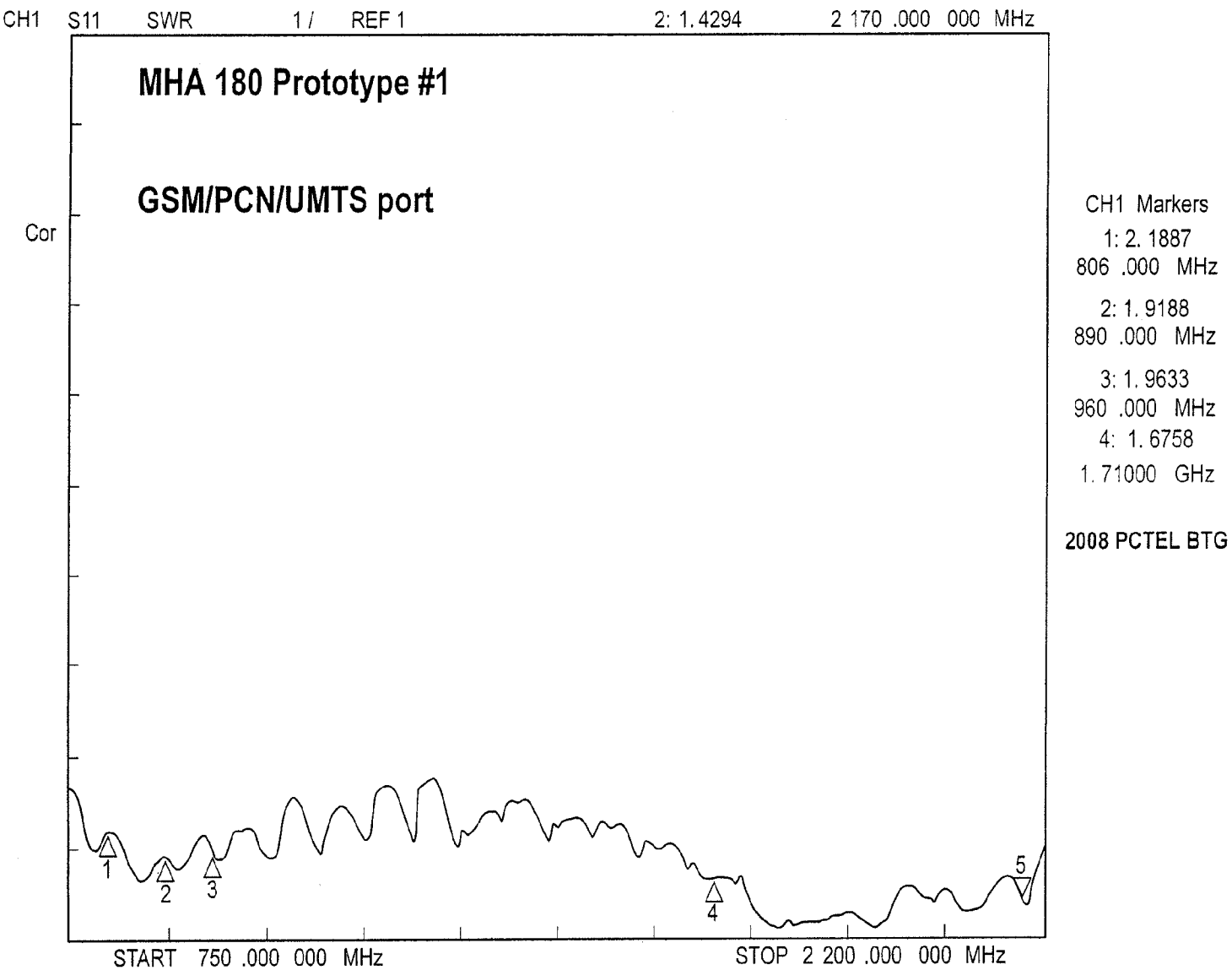
FIG. 4 is a SWR graph of a portion of the operating frequency range of the antenna of FIG. 1.
Figure 5:
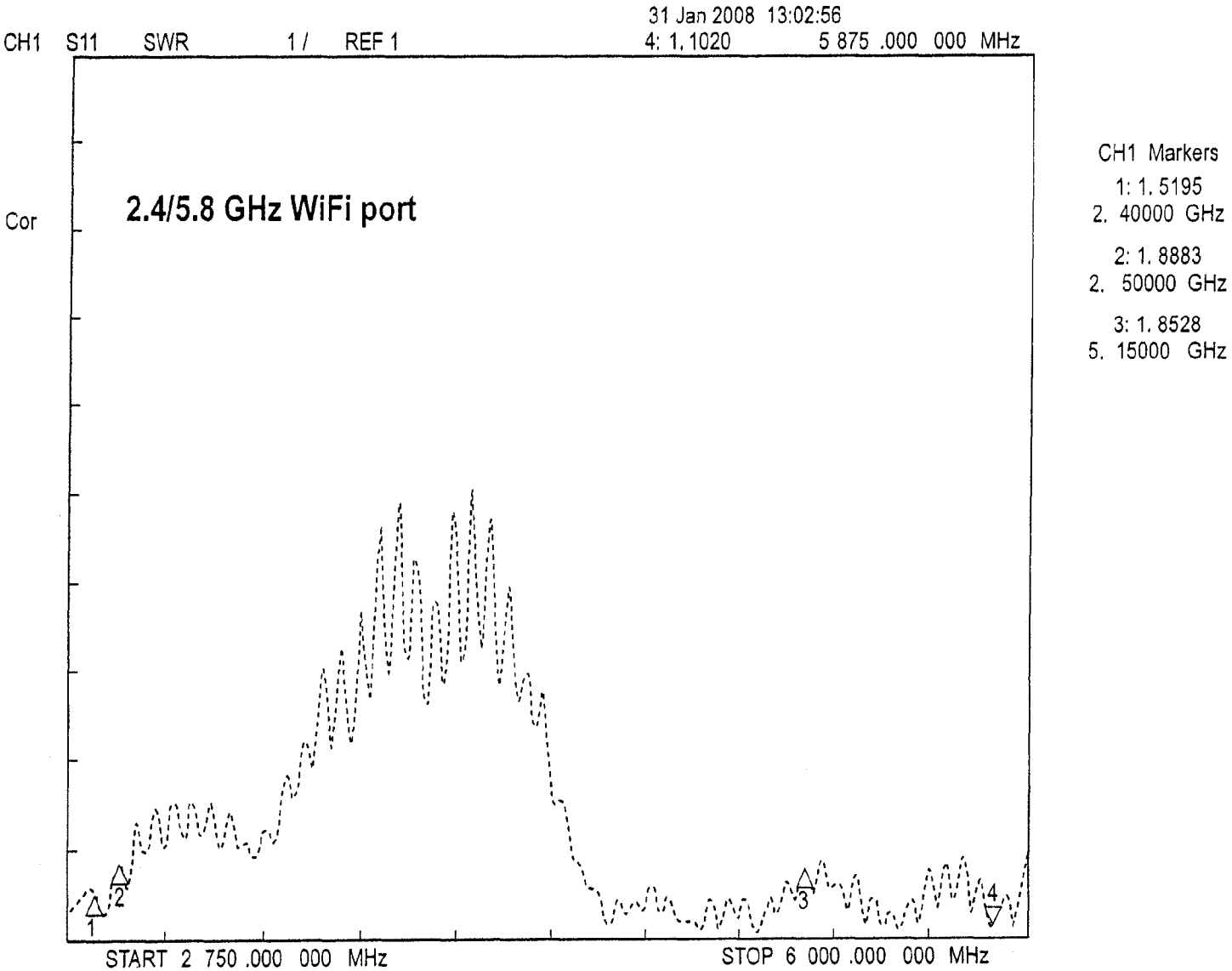
FIG. 5 is a SWR graph of another portion of the operating frequency range of the antenna of FIG. 1
Figure 6:
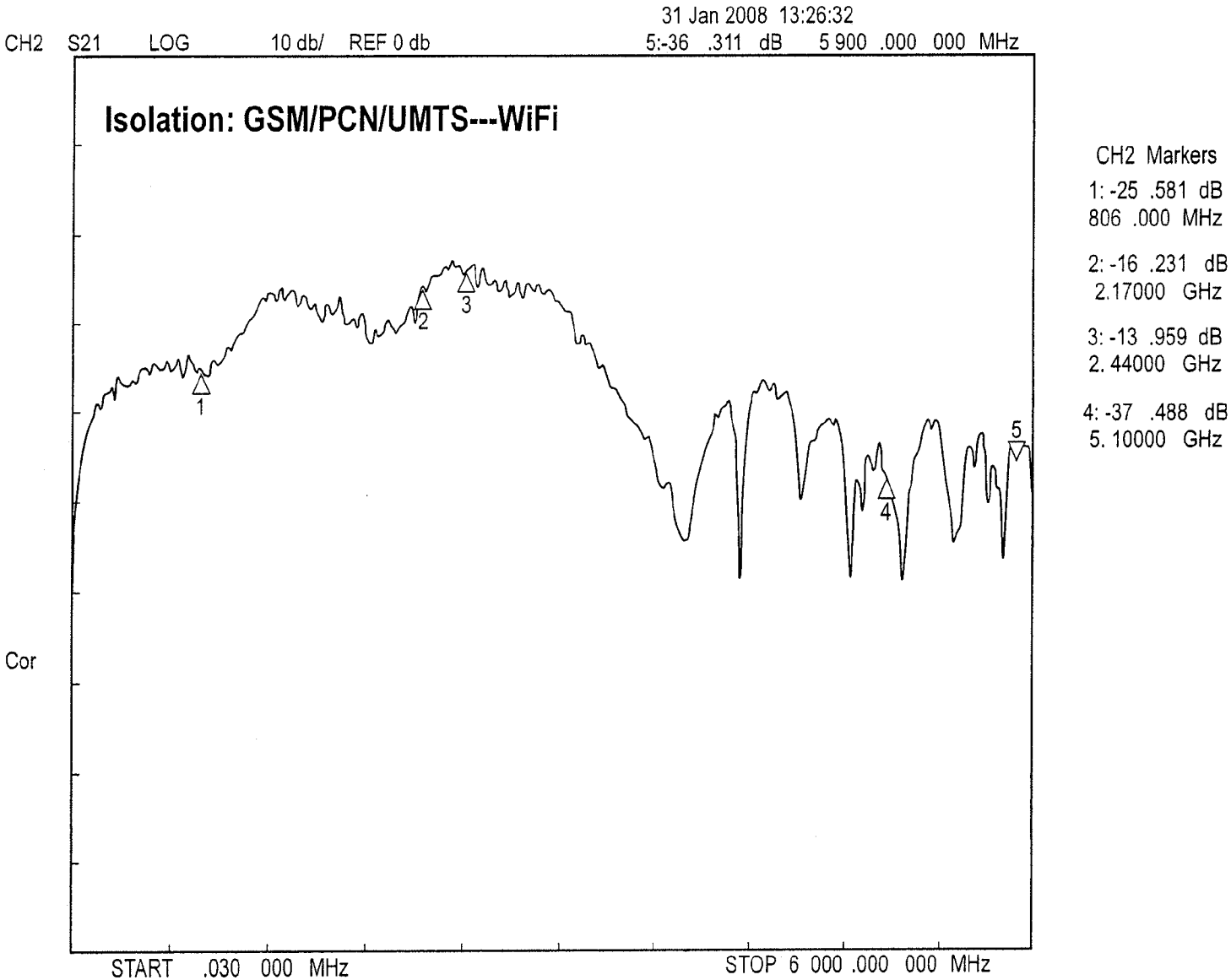
FIG. 6 is an isolation graph of the antenna of FIG. 1.

FIGS. 4-6 depict test data for the antenna 10. As shown in FIG. 4, the SWR in the frequency range of from 806 MHz to 1.7 GHz is less than 2.2. FIG. 5 shows that the SWR in the spectral regions of 2.4, 2.5 and 5.15 GHz is less than 2. FIG. 6 shows that the isolation in the appropriate frequency ranges is at least 13 dB. Selected dimensions for the antenna 10 include: a primary antenna 12 with a primary element 50 mm high with a folded top 66.5 mm long, the secondary antenna 14 has a set of secondary elements 34*a-d* that are 34 mm high and a support pads 44*a-d* that are 13 mm long by 3 mm wide and a high frequency antenna 16 with a set of high frequency elements 36*a-d* that each include a first element 11 mm high and a second element 38*b* 25 mm high.

The antenna 10 is extremely compact. The circuit boards 22, 24, 26 allow the respective subsets of elements 30, 34, 36 to be aligned in straight lines within a single plane. The use of straight lines allows the lower frequency elements to function as reflectors for the higher frequency elements. For example, on either PCB 24 or 25, the secondary elements 34*a-d* function as reflectors for a radiated signal from high frequency elements 36*a-d*.

In addition, the use of the antenna feed PCB 22 allows the secondary elements 34*a-d* to be arranged in a circle around the primary antenna 12 with the primary antenna 12 at the center of the circle. Similarly, the high frequency antenna elements 36*a-d* are also arranged in a circle with the primary antenna 12 at the center of the circle.

A specific embodiment of an antenna operating in non-harmonically related frequency bands has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A multi-band antenna that operates in non-harmonically related frequency bands, such antenna comprising:

a primary antenna element for a first frequency band of the non-harmonically related bands, said primary antenna element extending from a ground plane printed circuit board, the primary antenna element electrically isolated from the ground plane, first and second portions of said primary antenna element disposed on first and second interleaved printed circuit boards, respectively;

a plurality of secondary antenna elements extending from the ground plane parallel to the primary antenna element and arranged in a circle with the plurality of secondary antenna elements each capacitively coupled to the primary antenna element and ground plane so as to electrically float between an electrical potential of the primary antenna element and ground plane, first and second portions of said plurality of secondary antenna elements disposed on said first and second interleaved printed circuit boards, respectively; and a plurality of antenna elements for a second frequency band of the non-harmonically related bands, said plurality of second frequency band antenna elements electrically isolated from the ground plane and extending parallel to the primary and secondary antenna elements, the plurality of second frequency band antenna elements arranged in a circle that surrounds the secondary antenna elements with the primary element disposed at the center of both circles, first and second portions of said plurality of second frequency band antenna elements disposed on said first and second interleaved printed circuit boards, respectively, wherein the first portions of said primary antenna element, said plurality of secondary antenna elements, and said plurality of second frequency band antenna elements are aligned in a straight line on the first interleaved printed circuit board, and wherein the second portions of said primary antenna element, said plurality of secondary antenna elements, and said plurality of second frequency band antenna elements are aligned in a straight line on the second interleaved printed circuit board.

2. The multi-band antenna of claim 1 further comprises a cross-member extending from a distal end of the primary element parallel to the ground plane.

3. The multi-band antenna of claim 1 further comprises a pair of mutually orthogonal cross-members extending from a distal end of the primary element parallel to the ground plane.

4. The multi-band antenna of claim 1 further comprising at least some of the secondary elements, at least some of the second frequency band antenna elements and the primary element are disposed in a straight line wherein the secondary elements reflect radiation from the second frequency band antenna elements.

5. The multi-band antenna of claim 1 wherein each of the plurality of second frequency band antenna elements further comprise a pair of parallel elements.

6. The multi-band antenna of claim 1 further comprising a plurality of support pads disposed adjacent the ground plane and arranged in a circle around the primary antenna element, each of the plurality of support pads electrically connected to and supporting a respective secondary antenna element of the plurality of secondary antenna elements.

7. The multi-band antenna of claim 6 further comprising a dielectric spacer disposed between each of the plurality of support pads and the ground plane to electrically isolate the support pads and secondary antenna elements from the ground plane.

8. The multi-band antenna of claim 7 wherein the dielectric spacer further comprises at least one of the first or second interleaved printed circuit boards.

9. The multi-band antenna of claim 1 further comprising a quarter wavelength first frequency ground connection with a length defined by a base frequency of the first frequency band connected between the primary antenna element and the ground plane.

10. The multi-band antenna of claim 1 further comprising a quarter wavelength second frequency ground connection with a length defined by a base frequency of the second frequency band connected between the second frequency band antenna elements and the ground plane.

11. The multi-band antenna as in claim 1 operating in PCS, UMTS, and WIFI frequency bands.

12. A multi-band antenna that operates in non-harmonically related frequency bands, such antenna comprising:

a primary antenna element for a first frequency band of the non-harmonically related bands, said primary antenna element extending from a ground plane printed circuit board, the primary antenna element electrically isolated from the ground plane, first and second portions of said primary antenna element disposed on first and second interleaved printed circuit boards, respectively;

a plurality of secondary antenna elements electrically isolated from the primary antenna element extending from the ground plane parallel to the primary antenna element and arranged in a circle with the primary antenna element disposed at the center of the circle, each of said plurality of secondary antenna elements including a support pad disposed adjacent the ground plane that supports the secondary antenna element, first and second portions of said plurality of secondary antenna elements disposed on said first and second interleaved printed circuit boards, respectively;

a dielectric spacer disposed between each of the plurality of support pads and the ground plane to electrically isolate the support pads and secondary antenna elements from the ground plane; and a plurality of antenna elements for a second frequency band with a higher relative frequency than the first frequency band, the plurality of antenna elements for the second frequency band extending parallel to the primary and secondary antenna elements and disposed in a circle with the primary antenna element located at the center of the circle of antenna elements for the second frequency band, first and second portions of said plurality of antenna elements for the second frequency band disposed on said first and second interleaved printed circuit boards, respectively, wherein the first portions of said primary antenna element, said plurality of secondary antenna elements, and said plurality of antenna elements for the second frequency band are aligned in a straight line on the first interleaved printed circuit board, and wherein the second portions of said primary antenna element, said plurality of secondary antenna elements, and said plurality of antenna elements for the second frequency band are aligned in a straight line on the second interleaved printed circuit board.

13. The multi-band antenna as in claim 12 wherein the secondary antenna elements further comprise a length substantially equal to a quarter wavelength of a portion of the first frequency band.

14. The multi-band antenna as in claim 12 wherein the first frequency band further comprises 700-900 MHz.

15. The multi-band antenna as in claim 12 wherein the second frequency band further comprises 2.4-5.8 GHz.

16. A multi-band antenna that operates in non-harmonically related frequency bands, such antenna comprising:

a primary antenna element for a first frequency band of the non-harmonically related bands, said primary antenna element extending perpendicularly from a ground plane printed circuit board, the primary antenna element electrically isolated from the ground plane, first and second portions of said primary antenna element disposed on first and second interleaved printed circuit boards, respectively;

a plurality of secondary elements extending from the ground plane parallel to the primary antenna element and arranged in a circle around the primary antenna element, each of said plurality of secondary elements electrically isolated from the primary antenna element and ground plane, first and second portions of said plurality of secondary antenna elements disposed on said first and second interleaved printed circuit boards, respectively; and a plurality of antenna elements for a second frequency band of a higher relative frequency than the first frequency band, the plurality of antenna elements for the second frequency band extending parallel to the primary and secondary antenna elements and disposed in a circle around the secondary antenna elements, first and second portions of said plurality of antenna elements for the second frequency band disposed on said first and second interleaved printed circuit boards, respectively, wherein the first portions of said primary antenna element, said plurality of secondary antenna elements, and said plurality of antenna elements for the second frequency band are aligned in a straight line on the first interleaved printed circuit board, and wherein the second portions of said primary antenna element, said plurality of secondary antenna elements, and said plurality of antenna elements for the second frequency band are aligned in a straight line on the second interleaved printed circuit board.

17. The multi-band antenna as in claim 16 further comprising a support pad for each respective secondary element disposed on at least one of the first and second interleaved circuit boards that capacitively couples the secondary element to the ground plane.

18. The multi-band antenna as in claim 17 wherein the support pads further comprise a respective arc extending at least partially around the primary element.

19. The multi-band antenna as in claim 16 further comprising a first frequency one-half wavelength ground shunt that connects the primary antenna element to the ground plane.

20. The multi-band antenna as in claim 16 further comprising a second frequency one-half wavelength ground shunt that connects the antenna elements for the second frequency band to the ground plane.

* * * * *